US008468620B2

(12) United States Patent
Tarng

(10) Patent No.: US 8,468,620 B2
(45) Date of Patent: Jun. 25, 2013

(54) FAUCET STRUCTURE

(76) Inventor: Shao-Hwa Tarng, Changhua (TW)

( * ) Notice: Subject to any disclaimer, the term of this patent is extended or adjusted under 35 U.S.C. 154(b) by 401 days.

(21) Appl. No.: 13/010,177

(22) Filed: Jan. 20, 2011

(65) Prior Publication Data

US 2012/0186680 A1 Jul. 26, 2012

(51) Int. Cl.
*E03C 1/04* (2006.01)

(52) U.S. Cl.
USPC ..... 4/695; 4/677

(58) Field of Classification Search
USPC ..... 4/677, 695; 137/625.4
See application file for complete search history.

(56) References Cited

U.S. PATENT DOCUMENTS 3,009,167 A * 11/1961 Leonard, Jr. ..... 4/695
5,558,128 A * 9/1996 Pawelzik et al. ..... 137/801
5,685,341 A * 11/1997 Chrysler et al. ..... 137/801
6,868,564 B2 * 3/2005 Ginter et al. ..... 4/677
6,912,742 B1 * 7/2005 Wang ..... 4/695
7,032,619 B2 * 4/2006 Gaenzle ..... 137/615
7,828,013 B2 * 11/2010 Lin ..... 137/801
8,051,507 B2 * 11/2011 Lin ..... 4/677

* cited by examiner

*Primary Examiner* — John Fox
(74) *Attorney, Agent, or Firm* — Jackson IPG PLLC

(57) ABSTRACT

A faucet structure includes a faucet main body, a limit disc and a plurality of guide pipes. The faucet main body includes a plurality of inlet passages and a plurality of inlets at lower ends of the inlet passages to connect upper ends of the guide pipes. At least one side of each inlet has an engaging recess for engagement of a limit protrusion of the corresponding guide pipe. The faucet main body has a threaded hole at a bottom thereof. Each guide pipe includes a stop ring and a neck part fitted on the upper end thereof. The neck part has the limit protrusion at one side thereof. The limit disc has a plurality of through holes and a hole corresponding in position to the inlets and the threaded hole.

3 Claims, 4 Drawing Sheets

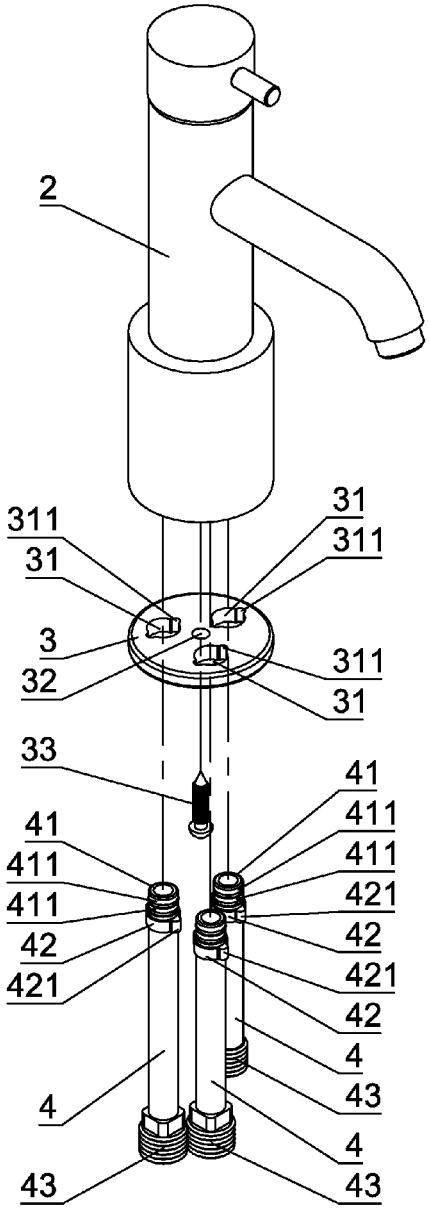
Fig. 1
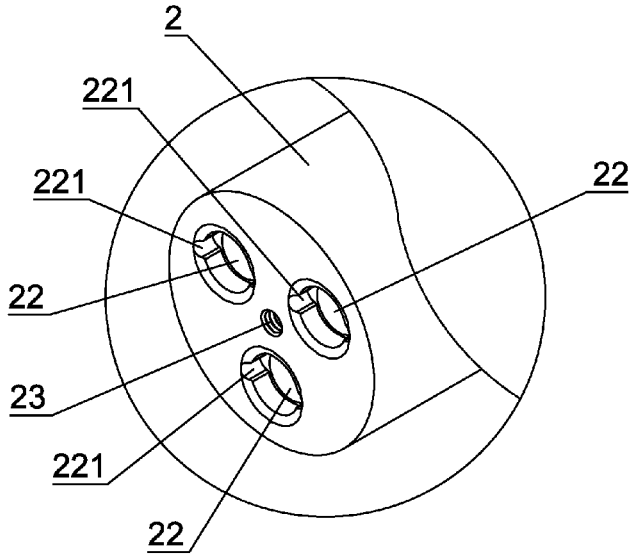
Fig. 1-A

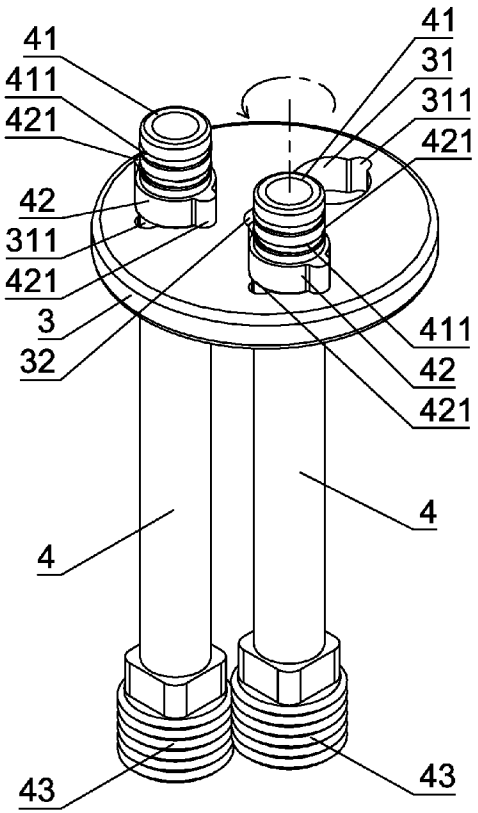
Fig. 5-C
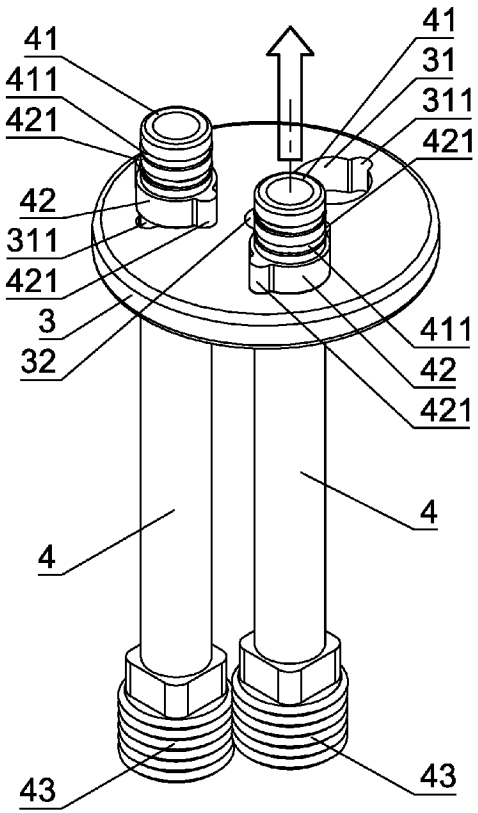
Fig. 5-B
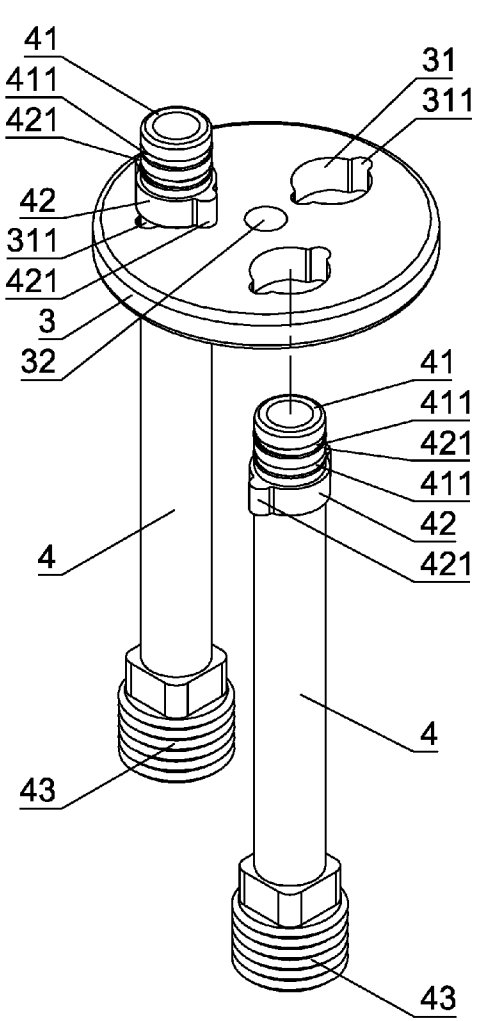
Fig. 5-A

FAUCET STRUCTURE

BACKGROUND OF THE INVENTION

1. Field of the Invention

The present invention relates to a faucet structure, and more particularly to a faucet structure which can be assembled with ease.

2. Description of the Prior Art

A conventional facet has a plurality of inlet passages. The lower ends of the inlet passages are connected with upper ends of guide pipes by weld. The lower ends of the guide pipes are connected with a water pipe to supply water. However, the space between the guide pipes is limited. It is not easy to weld the guide pipes. When assembling, the lower ends of the guide pipes must be adjusted to connect with the water pipe. During adjustment, the welding point is used as a pivot for bending the guide pipe, which may result in a crack. When the repair is required, it is a hard job to weld the guide pipe because the guide pipe is located under sink. Accordingly, the inventor of the present invention has devoted himself based on his many years of practical experiences to solve this problem.

SUMMARY OF THE INVENTION

The primary object of the present invention is to provide a faucet structure which provides a tight connection between an upper end of a guide pipe and an inlet.

A further object of the present invention is to provide a faucet structure which provides a simply way to assemble and disassemble the guide pipes for repair and maintenance.

In order to achieve the aforesaid objects, there is provided a faucet structure which comprises a faucet main body, a limit disc and a plurality of guide pipes. The faucet main body includes a plurality of inlet passages and a plurality of inlets at lower ends of the inlet passages to connect upper ends of the guide pipes. At least one side of each of the inlets has an engaging recess for engagement of a limit protrusion of the corresponding guide pipe. The faucet main body has a threaded hole at a bottom thereof. The limit disc has a plurality of through holes and a hole corresponding in position to the inlets and the threaded hole of the faucet main body. At least one side of each of the through holes has a limit recess which is not aligned with the engaging recess. The limit disc is coupled to the bottom of the faucet main body by a screw which is screwed to the threaded hole. Each of the guide pipes includes a stop ring and a neck part fitted on the upper end thereof. The neck part has the limit protrusion at one side thereof. Each of the guide pipes has a lower end to connect a water pipe. Thereby, the limit disc is used to stop the limit protrusion from moving downward and the engaging recess limits the limit protrusion from rotation. The lower end of the guide pipe can be bent to connect the water pipe with the through hole as a pivot, not influencing the connection between the upper end and the inlet. When the maintenance is required, the parts of the present invention can be disassembled with ease.

Preferably, the engaging recess corresponds in shape to the limit recess of the limit disc and the limit protrusion of the guide pipe, having a semi-circle, triangle or square shape.

The advantage of the present invention is that the faucet main body has the inlets at the lower ends of the inlet passages to connect the upper ends of the guide pipes. At least one side of each of the inlets has the engaging recess for engagement of the limit protrusion of the corresponding guide pipe. The faucet main body has the threaded hole at the bottom thereof. Each guide pipe includes the stop ring and the neck part fitted on the upper end. The neck part has at least one limit protrusion at one side thereof. Each guide pipe has the lower end to connect the water pipe. The limit disc has the plurality of through holes and the hole corresponding in position to the inlets and the threaded hole of the faucet main body, respectively. At least one side of each of the through holes has the limit recess which is not aligned with the engaging recess. The upper ends of the guide pipes are inserted through the through holes of the limit disc with the limit protrusion of the neck part passing the limit recess, such that the guide pipes are connected to the limit disc. After that, the upper ends of the guide pipes are rotated to align with the inlets of the faucet main body with the limit protrusion to engage with the engaging recess. Finally, the screw is inserted through the through hole of the limit disc and screwed in the threaded hole of the faucet main body, so that the guide pipes and the limit disc are coupled to the faucet main body. Because the engaging recess is not in alignment with the limit recess, the limit disc stops the limit protrusion from moving downward and the engaging recess limits the limit protrusion from rotation. The lower end of the guide pipe can be bent to connect with the water pipe with the through hole as a pivot, not influencing the connection between the upper end and the inlet.

When the maintenance is required, the parts of the present invention can be disassembled with ease.

BRIEF DESCRIPTION OF THE DRAWINGS

FIG. 1 is an exploded view according to a preferred embodiment of the present invention;

FIG. 1-A is a perspective view showing the bottom of the facet main body according to the preferred embodiment of the present invention;

FIG. 5-A to C are schematic views showing the guide pipes and the limit disc according to the preferred embodiment of the present invention.

DETAILED DESCRIPTION OF THE PREFERRED EMBODIMENTS

Embodiments of the present invention will now be described, by way of example only, with reference to the accompanying drawings.

Figure 2:
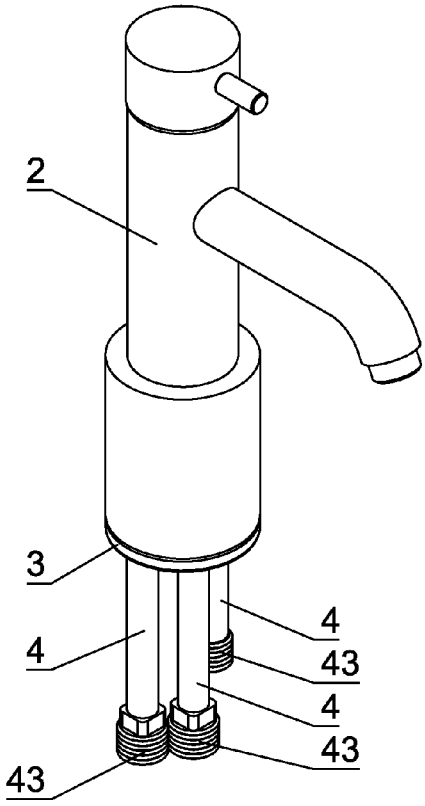
FIG. 2 is a perspective view according to the preferred embodiment of the present invention.
Figure 3:
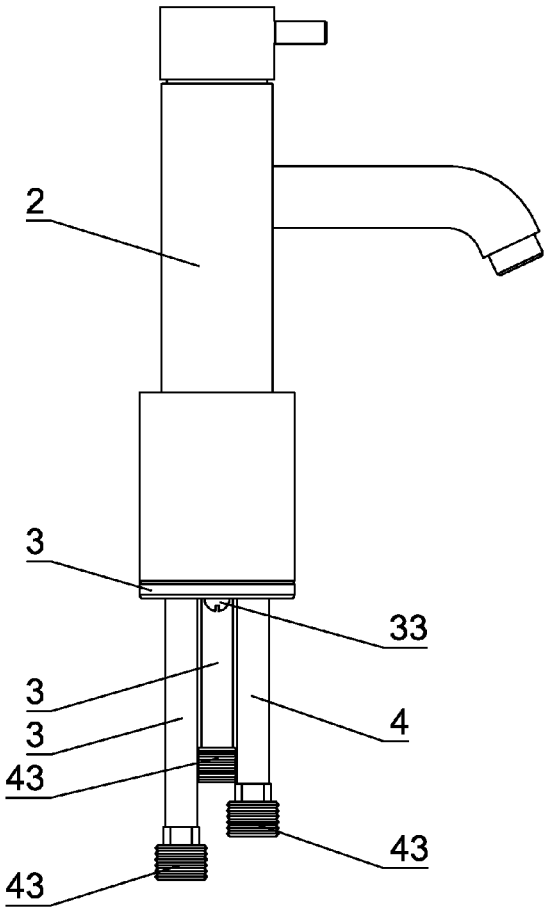
FIG. 3 is a side view according to the preferred embodiment of the present invention.
Figure 4:
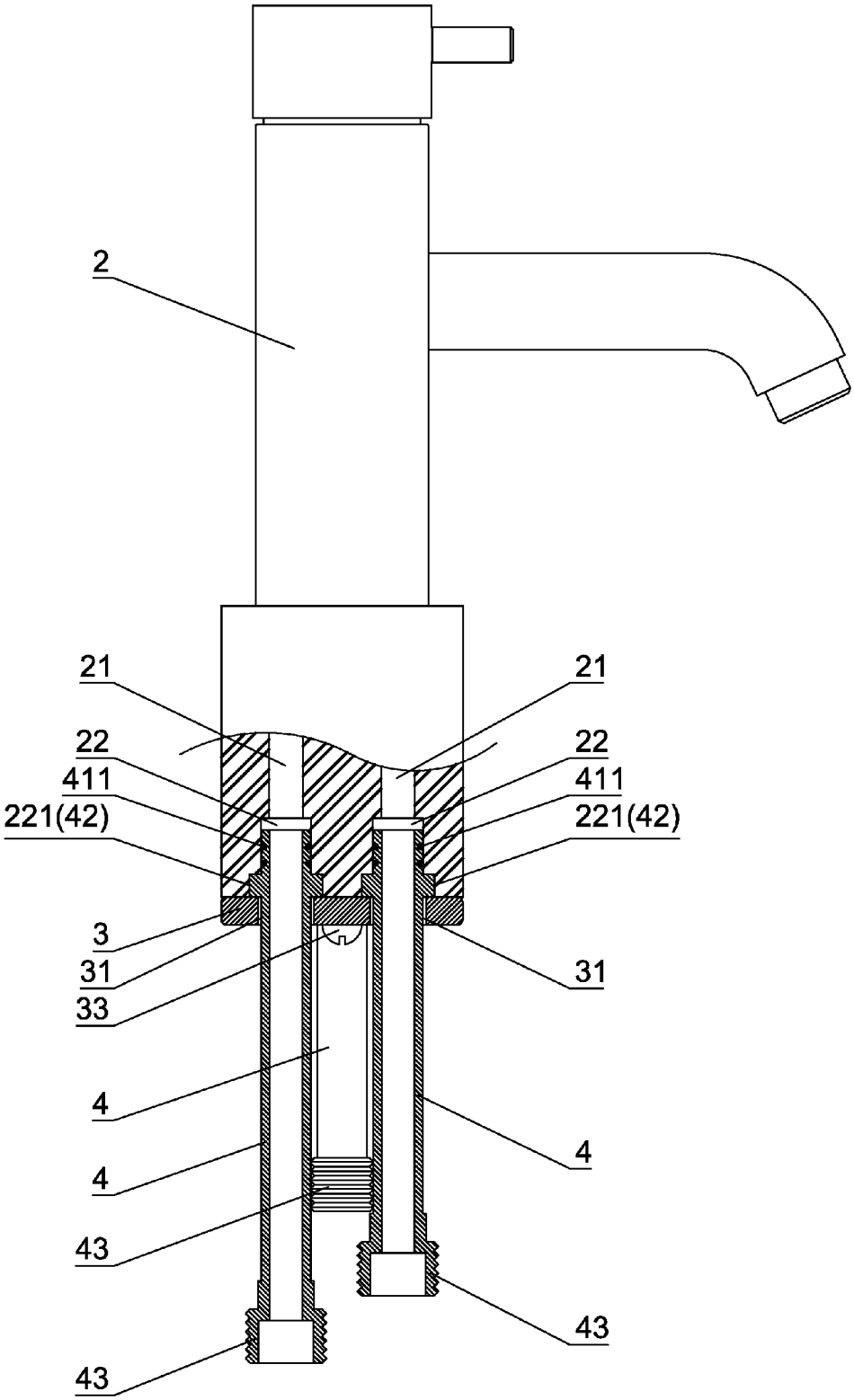
FIG. 4 is a cross-sectional view according to the preferred embodiment of the present invention.

As shown in FIG. 1, FIG. 4 and FIG. 1-A, a faucet structure according to a preferred embodiment of the present invention comprises a faucet main body 2, a limit disc 3, and a plurality of guide pipes 4.

The faucet main body 2 includes a plurality of inlet passages 21 and a plurality of inlets 22 at lower ends of the inlet passages 21 to connect upper ends of the guide pipes 4. At least one side of each of the inlets 22 has an engaging recess 221 for engagement of a limit protrusion 421 of the corresponding guide pipe 4, so that the guide pipe 4 cannot be rotated. The faucet main body 2 has a threaded hole 23 at a bottom thereof. The limit disc 3 is coupled to the bottom of the faucet main body 2 by a screw 33 screwed to the threaded hole 23.

The limit disc 3 has a plurality of through holes 31 and a hole 32 corresponding in position to the inlets 22 and the threaded hole 23 of the faucet main body 2, respectively. At least one side of each of the through holes 31 has a limit recess 311 which is not aligned with the engaging recess 221. After the guide pipes 4 are connected to the limit disc 3, the screw 33 is screwed in the threaded hole 23 to couple the limit disc 3 to the bottom of the faucet main body 2.

Each guide pipe 4 includes a stop ring 411 and a neck part 42 fitted on the upper end 41. The neck part 41 has at least one limit protrusion 421 at one side thereof. The neck part 41 is inserted through the through hole 31 and the limit recess 311 of the limit disc 3 and engaged with the engaging recess 221 of the corresponding inlet 22 of the faucet main body 2. Each guide pipe 4 has a lower end 43 to connect a water pipe. The present invention provides a simple and convenient way to assemble the guide pipes.

Referring to FIG. 2 to FIG. 4, FIG. 5-A to C, the upper ends 41 of the guide pipes 4 are inserted through the through holes 31 of the limit disc 3 with the limit protrusion 421 of the neck part 42 passing the limit recess 311 as shown in FIG. 5-C and FIG. 5-B, such that the guide pipes 4 are connected to the limit disc 3. After that, the upper ends 41 of the guide pipes 4 are rotated to align with the inlets 22 of the faucet main body 2 with the limit protrusion 421 to engage with the engaging recess 221, as shown in FIG. 5-C. Finally, the screw 33 is inserted through the through hole 32 of the limit disc 3 and screwed in the threaded hole 23 of the faucet main body 2 as shown in FIG. 4, such that the guide pipes 4 and the limit disc 3 are coupled to the faucet main body 2. Because the engaging recess 221 is not in alignment with the limit recess 311, the limit disc 3 stops the limit protrusion 421 from moving downward and the engaging recess 221 limits the limit protrusion 421 from rotation. The lower end 43 of the guide pipe 4 can be bent to connect the water pipe with the through hole 31 as a pivot, not influencing the connection between the upper end 41 and the inlet 22. When the maintenance is required, the parts of the present invention can be disassembled with ease.

The engaging recess 221 corresponds in shape to the limit recess 311 of the limit disc 3 and the limit protrusion 421 of the guide pipe 4, which has geometry shape, such as a semi-circle, triangle or square shape.

Accordingly, the upper ends of the guide pipes 4 of the present invention are insertedly connected to the bottom of the faucet main body 2 with ease, providing a simply assembly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A faucet structure comprising:

a faucet main body, a limit disc, and a plurality of guide pipes;

the faucet main body including a plurality of inlet passages and a plurality of inlets at lower ends of the inlet passages to connect with upper ends of the guide pipes, at least one side of each of the inlets having an engaging recess for engagement of a limit protrusion of the corresponding guide pipe, the faucet main body having a threaded hole at a bottom thereof;

the limit disc having a plurality of through holes and a hole corresponding in position to the inlets and the threaded hole of the faucet main body, at least one side of each of the through holes having a limit recess which is not aligned with the engaging recess, the limit disc being coupled to the bottom of the faucet main body by a screw which is screwed to the threaded hole;

each of the guide pipes including a stop ring and a neck part fitted on the upper end thereof, the neck part having the limit protrusion at one side thereof, each of the guide pipes having a lower end to connect a water pipe.

2. The faucet structure as claimed in claim 1, wherein the engaging recess corresponds in shape to the limit recess of the limit disc and the limit protrusion of the guide pipe, having a semi-circle, triangle or square shape.

3. The faucet structure as claimed in claim 1, wherein the engaging recess corresponds in shape to the limit recess of the limit disc and the limit protrusion of the guide pipe, having a geometry shape.

* * * * *